United States Patent [19]

Boser

[11] Patent Number: 4,674,422

[45] Date of Patent: Jun. 23, 1987

[54] APPARATUS FOR SEWING ZIPPER CHAIN TO ELONGATED FABRIC PIECES

[75] Inventor: Ronald J. Boser, Huntington, N.Y.

[73] Assignee: Yoshida Kogyo K. K., Tokyo, Japan

[21] Appl. No.: 894,117

[22] Filed: Aug. 7, 1986

[51] Int. Cl.[4] ..... D05B 23/00

[52] U.S. Cl. ..... 112/121.27; 112/104; 112/113; 112/130; 112/272; 112/305

[58] Field of Search ..... 112/121.27, 121.26, 112/104, 113, 130, 272, 277, 305, 114

[56] References Cited

U.S. PATENT DOCUMENTS

| | | | |
|---|---|---|---|
| 2,483,138 | 9/1949 | Helmer | 112/272 |
| 3,363,594 | 1/1968 | Kosrow | 112/272 |
| 4,274,347 | 6/1981 | Rohrer | 112/104 |
| 4,497,270 | 2/1985 | Boser | 112/104 X |
| 4,541,352 | 9/1985 | Boser et al. | 112/121.26 X |
| 4,572,088 | 2/1986 | Matsuda | 112/104 |
| 4,593,635 | 6/1986 | Boser et al. | 112/305 X |
| 4,611,546 | 9/1986 | Miyakawa | 112/272 X |

*Primary Examiner*—H. Hampton Hunter

*Attorney, Agent, or Firm*—Hill, Van Santen, Steadman & Simpson

[57] ABSTRACT

A method of sewing and an automatic sewing apparatus for accurately aligning fabric pieces and continuously fed zipper chain at a sewing station and sequentially thereafter sewing the chain into the fabric in zipper-closed condition, cutting the chain to a length determined by the length of the fabric, cutting the sewing thread upon completion of the sewing operation and stacking the assembled fabric and zipper combination for subsequent removal.

13 Claims, 9 Drawing Figures

APPARATUS FOR SEWING ZIPPER CHAIN TO ELONGATED FABRIC PIECES

BACKGROUND OF THE INVENTION

This invention relates to the automatic sewing of an elongated fabric workpiece such as childrens' sleepwear, curtains, womens dress, and the like, and in particular to a method and apparatus for sewing continuous slide fastener chain to elongated fabric pieces intended to be joined by the zipper chain.

The invention is an improvement of apparatus shown and claimed in my preceding U.S. Pat. No. 4,497,270, the substance of which is incorporated herein by reference.

As has been described in my preceding patent, it has often been necessary in the sewing of elongated fabric workpieces to provide relatively intricate manual positioning of the fabric in the sewing machine, and to provide accurate alignment of the fabric relative to unit zippers being sewn therein. Prior to the development of the apparatus of my above mentioned U.S. Pat. No. 4,497,270, the sewing of elongated fabric pieces to unit type zippers had required extremely skillful hand sewing operation. The inevitable result of sewing assembly operations requiring a high level of manual dexterity is that the resulting product is non-uniform. As those familiar with the sewing of clothing are aware, the appearance of the final garment is critically dependent upon the skill of the person operating the sewing machine, and manual sewing results in a substantial number of unsatisfactory garments.

In accordance with my prior patent, automatic machine pulling of the fabric pieces through a sewing station, under controlled tension, was successfully accomplished. As a result of the structure therein disclosed, garments having long unit type zippers were successfully produced, with substantially improved uniformity of sewn product. However, the successful utilization of the machine there described requires substantial manual dexterity in the initial assembly of the zipper and fabric to be sewn therewith. While such dexterity is available, nevertheless the desirability of minimizing the requirement for such physical abilities has led to the improved, substantially completely automatic, sewing apparatus of the present invention.

As will be understood from the construction of my prior U.S. Pat. No. 4,497,270, the embodiment there illustrated called for insertion of a unit type zipper (a preassembled zipper comprised of a pair of chains engaged with a slider) in a fixture positioning the tape edge of each of the chains adjacent the edge of the fabric. Upon completion of the sewing operation, the zipper was closed by manipulating the slider, at which point the stitched edges of the fabric were turned under and the zipper became substantially concealed. The manual positioning of the zipper parts and the manual positioning of the fabric in advance of the sewing operation permit possible misalignment and other operator errors unless careful attention is constantly paid to the apparatus during initiation of the sewing operation.

OBJECTS AND SUMMARY OF THE INVENTION

In accordance with the present invention, long pieces of fabric are sewn to a continuous length of zipper chain which is presented to the sewing station of the machine in the engaged, or closed, condition. A slider mechanism is assembled into the zipper at a subsequent station not associated with the apparatus of the present invention. In accordance with the present invention, the zipper chain is supplied to the apparatus from a continuous supply reel. It is mechanically manipulated and directed to the sewing station without manual effort or control. At the same time, an operator positions two pieces of fabric against a mechanical guide in a relatively non-critical location. Upon actuation of the apparatus, the fabric is manipulated by the machine to place it in precise alignment with the zipper chain, to fold the material over so that a folded edge is positioned immediately below the zipper chain, and upon completion of the automatic positioning the sewing station stitches, simultaneously, both sides of the zipper chain to the respective pieces of fabric. The chain and attached fabric are gripped and pulled forwardly under tension as described in my prior U.S. Pat. No. 4,497,270, completely through the sewing station. In accordance with the present invention, the trailing edge of the fabric is sensed and the chain is automatically cut to length, so that the length of zipper chain provided for each garment is established by the length of the garment itself and may vary from piece to piece.

Upon completion of the sewing operation and the pulling of the assembled fabric to a point clear of the apparatus, a lateral discharge apparatus is provided, in accordance with the present invention, to move the assembled product to a storage platform. In accordance with the present invention, that platform is continually adjustable in height to establish a satisfactory stacking condition. Upon lateral movement of the fabric to the stacking shelf, the pulling mechanism is returned to its position immediately adjacent the sewing station and a new sewing cycle may be initiated.

DETAILED DESCRIPTION OF THE INVENTION

Figure 1:
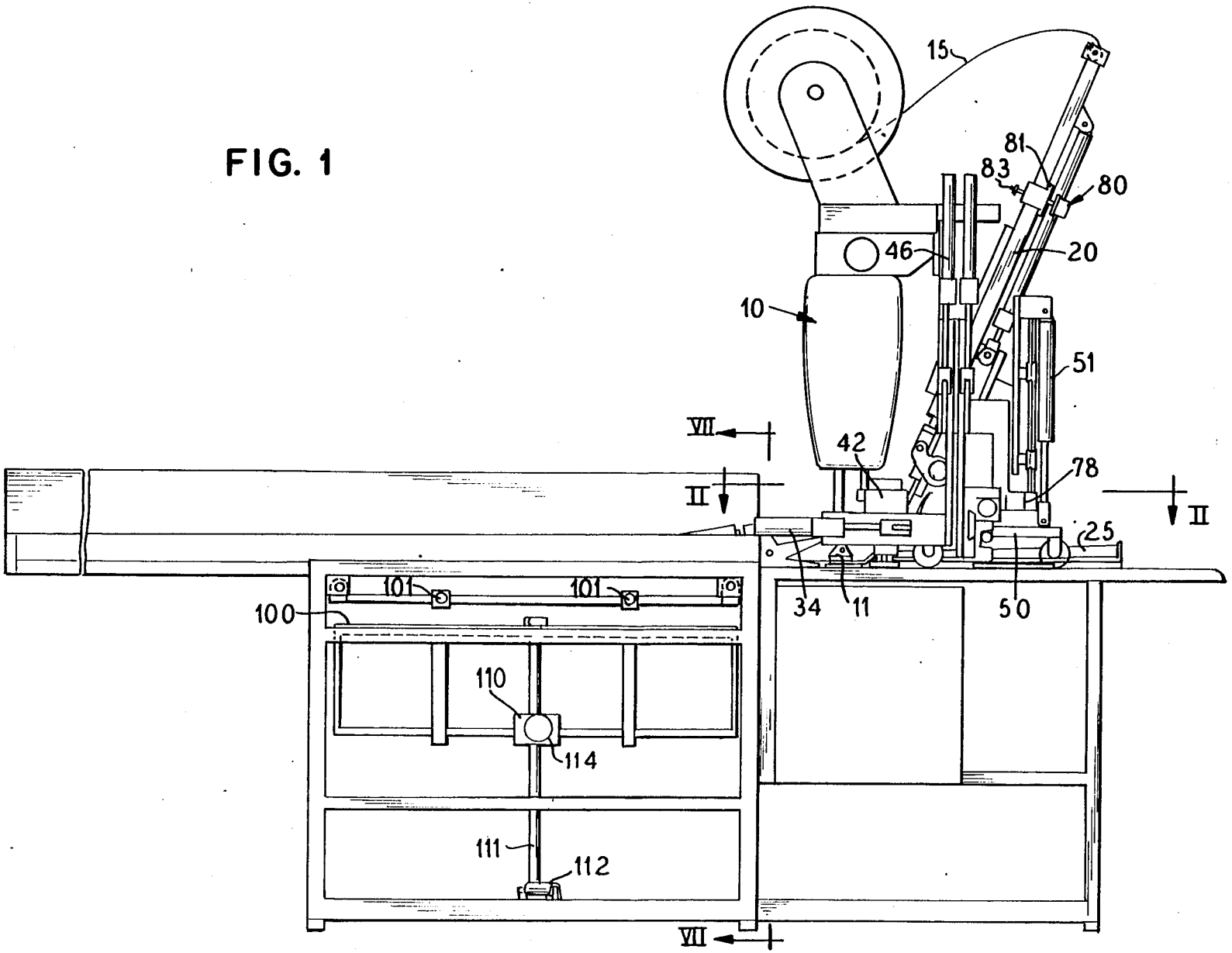
FIG. 1 is a diagrammatic side elevational view of the apparatus of the present invention.
Figure 2:
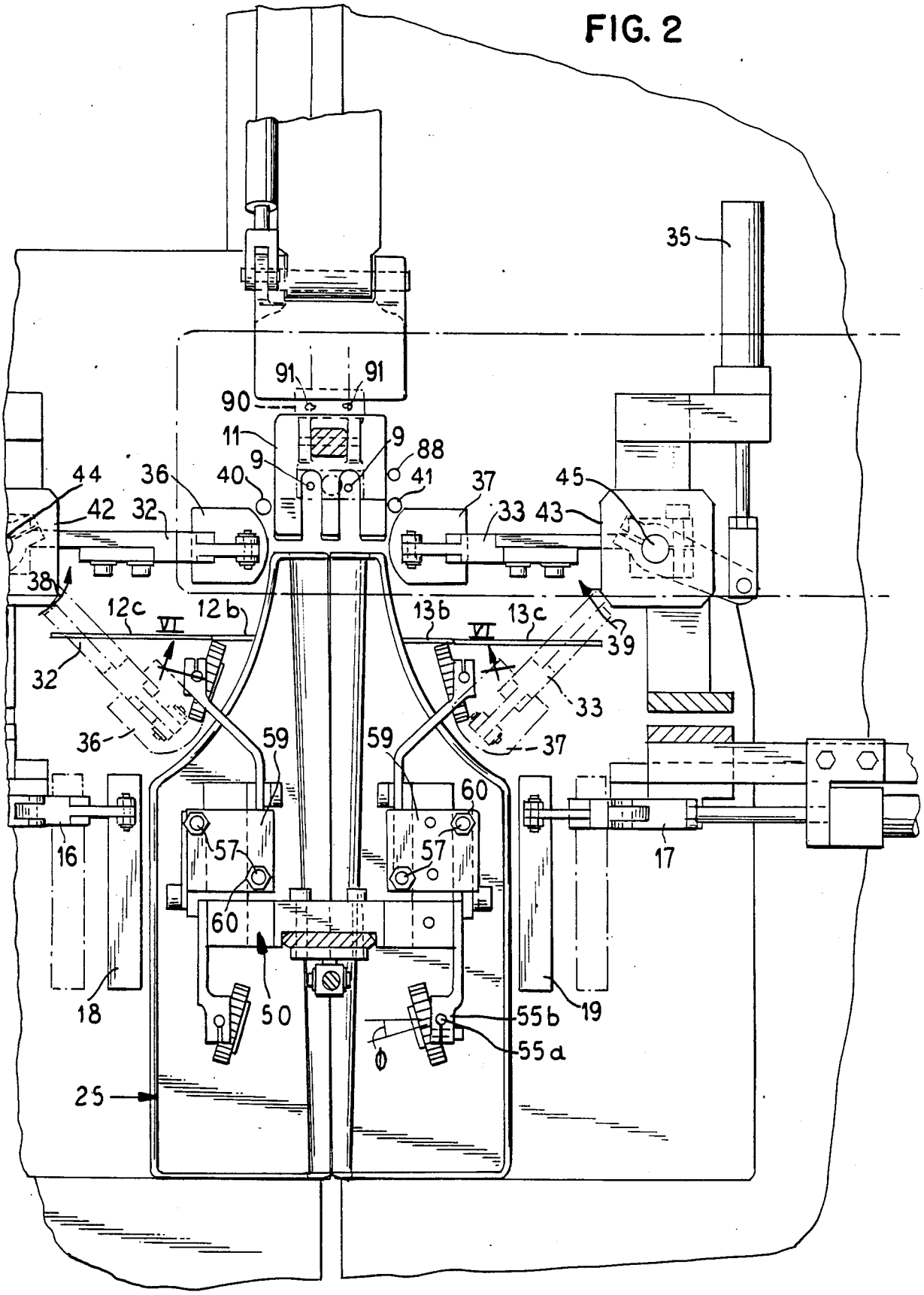
FIG. 2 is an enlarged partial plan view of the sewing station and fabric feed guides taken generally along the line II—II of FIG. 1.

The over all operation of the sewing apparatus of the present invention may be understood from FIG. 1. As there shown, a sewing machine generally indicated at 10 may comprise any conventional double needle sewing machine designed to provide a pair of parallel lines of stitching to, and through, goods passing beneath its presser foot 11. While conventional practice typically employs chain stitching, it will be understood that lock stitching may be employed, if desired. The goods being sewn comprise two pieces of fabric introduced to the sewing machine from the right hand side of the apparatus shown in FIG. 1, and the zipper chain 15 which is fed to, and under, the presser foot 11 by way of a chain guide 20. The fabric pieces 12 and 13 are placed adjacent the edge turning and guide mechanism 25, with the edges 12*a* and 13*a*, respectively, positioned generally against the inside edges of the edge turning device 25 with the leading edge of the fabric 12*b* and 13*b* positioned approximately along a mark indicated generally at 12*c* and 13*c* adjacent the edge turning guide 25, as shown in FIG. 2.

Figure 3:
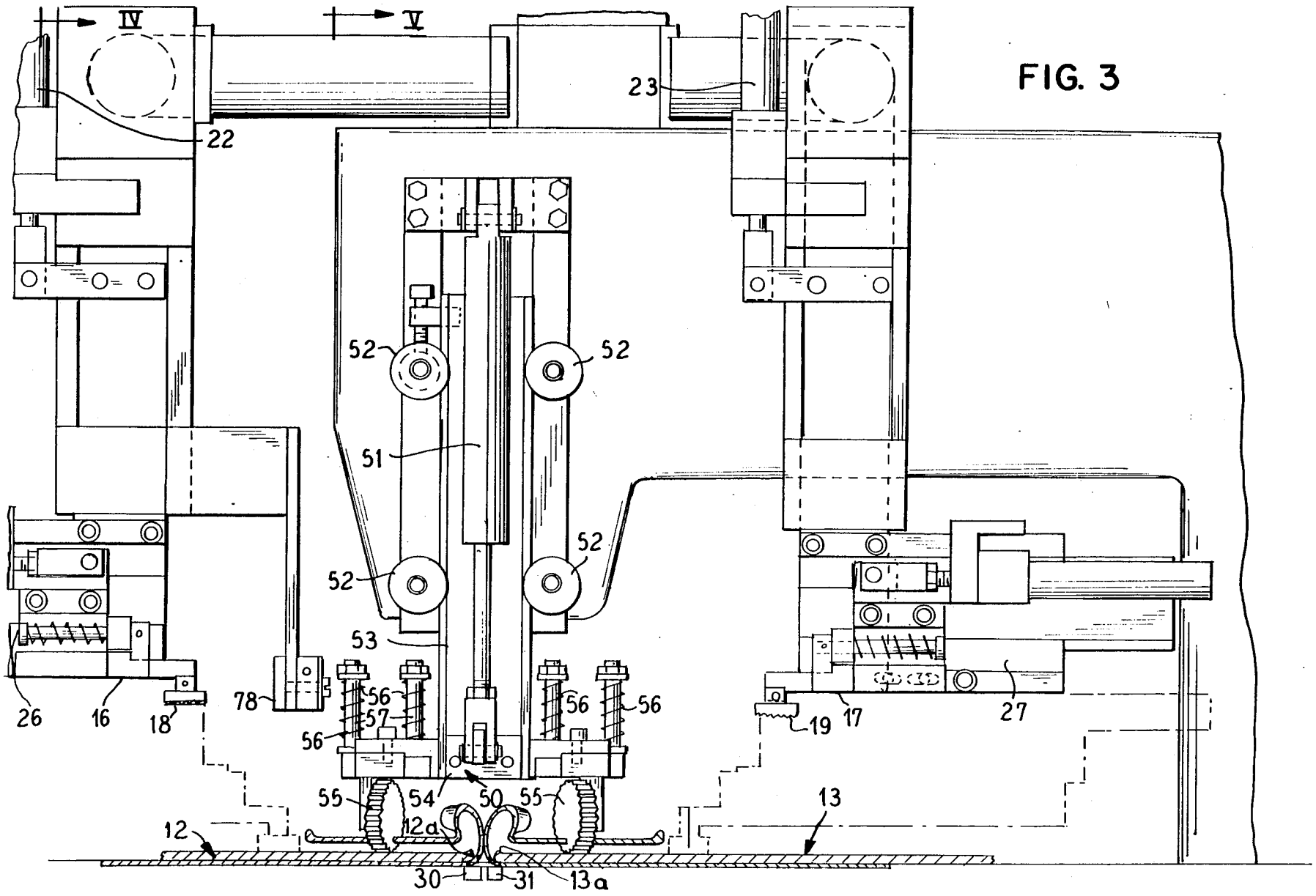
FIG. 3 is a partial, enlarged end elevational view of the apparatus as viewed from the right in FIG. 1.
Figure 4:
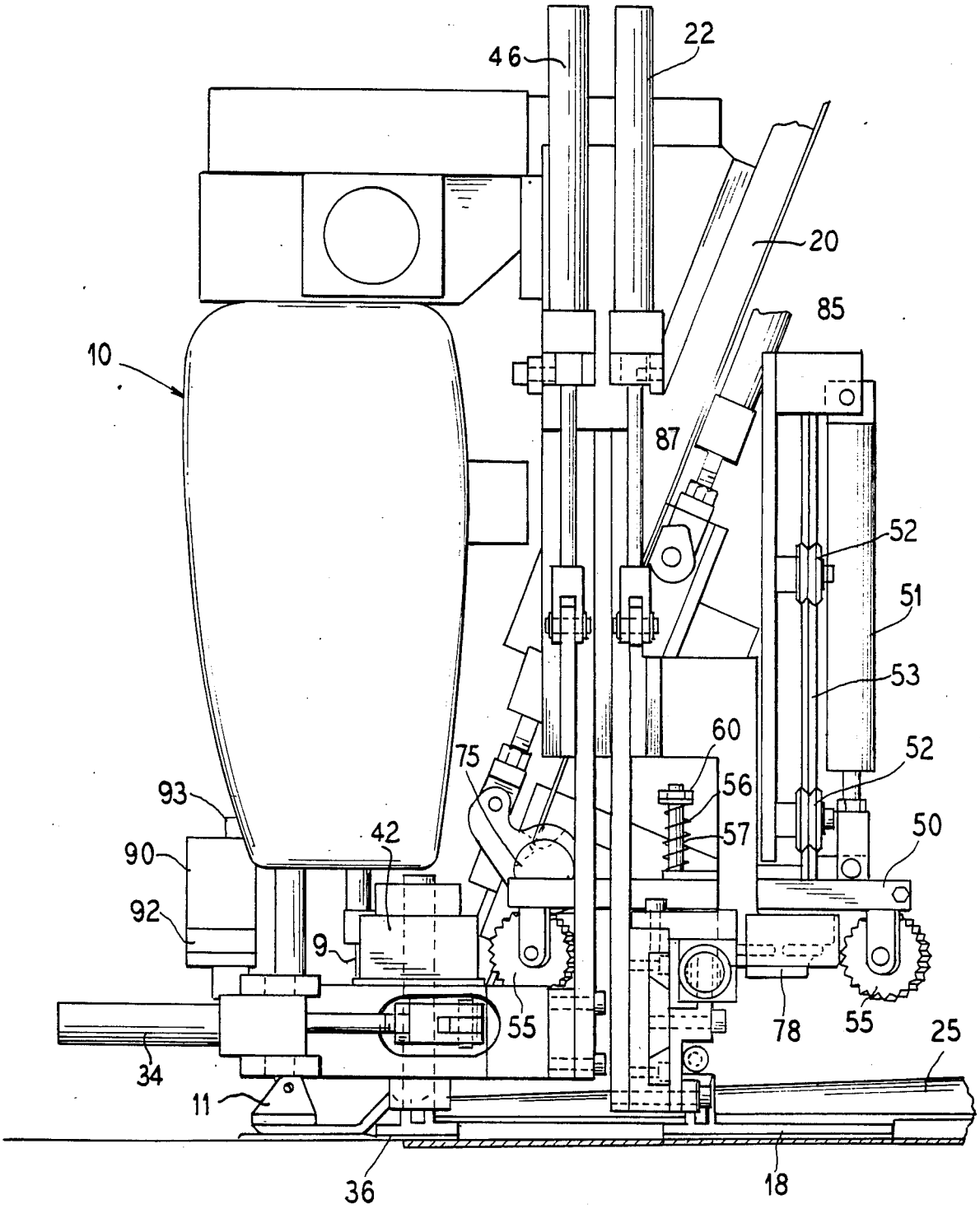
FIG. 4 is an enlarged partial cross-sectional view taken along the line IV—IV of FIG. 3.

Upon the initial, approximate, alignment of the fabric pieces 12 and 13 as above noted, the operator presses a start button conveniently located but preferably immediately above the edge turning device 25. Upon pressing the start button center-feeding devices 16 and 17 carrying fabric grippers 18 and 19 are reciprocated downwardly from the solid position lines shown in FIG. 3, by respective air cylinders 22, 23. Upon reaching the down position of FIG. 4, and upon contact with the fabric, laterally moving cylinders 26,27 are energized by a conventional position responsive control switch, causing the grippers 18 and 19 to move towards each other, and the edge turning device. This movement continues in the case of each of the cylinders 26,27 until a sensing device such as those shown at 30,31 optically sense the fabric edges 12*a*, 13*a* to be at the desired central condition as shown in FIG. 3. At this point the cylinders 26 and 27 are stopped from further movement and the cylinders 22, 23 energize to move their respective gripping members 16 and 17 upwardly, freeing the fabric pieces.

Figure 6:
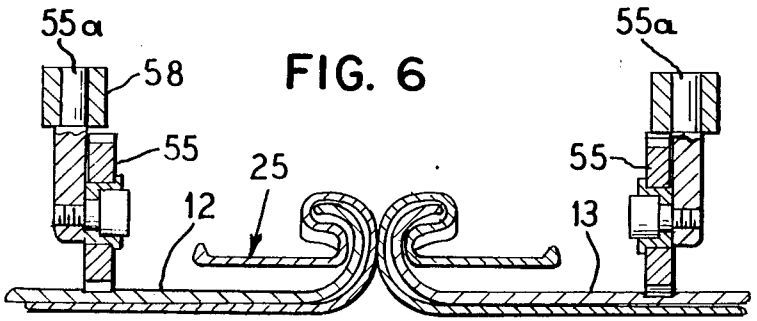
FIG. 6 is a partial cross-sectional view taken along the line VI—VI of FIG. 2.

As the center-feeding devices 16,17 move upwardly, the material edge-turning devices 32,33 are moved downwardly placing arcuately moving fabric grippers 36,37 in contact with the fabric pieces 12, 13 adjacent the leading edge thereof. Thereafter, the material edge turning device is energized, and as a result, the device 32 is rotated in a counterclockwise direction of the arrow 38 in FIG. 2 by cylinder 34, and the device 33 is rotated in the clockwise direction as shown in FIG. 2 at the arrow 39 by cylinder 35. The result of the arcuate movement of members 32 and 33, is that the inner edges 12*a*, 13*a* of the fabric are forced inwardly and forwardly, assuming the turned configuration shown in FIG. 6, with the leading edges 12*b*, 13*b*, moving forwardly under the location of the presser foot 11 and under the leading edge of the zipper chain 15 protruding from the lower end of the chain supply guide 20.

Conventional electric eyes may be positioned as at 40,41 for sensing the location of the fabric in the advanced position for stitching. It is quite possible, in practice, that the individual fabric pieces are slightly misaligned in their longitudinal-direction movement paths, and, accordingly, the edge-turning device sensors 40,41, may become energized at different times, indicating that the individual fabric pieces have arrived at their desired position at slightly different times. Immediately upon each of the sensors 40,41 being energized, an air or solenoid actuated brake, indicated at 42, 43 locks the respective pivot shaft 44,45 stopping arcuate movement of the respective grippers 36,37 at the position in which the respecive fabric piece is in its final desired position for the initiation of sewing.

Upon the actuation of the brake locks, and the cessation of the forward movement of the fabric, the material edge turning device members 32,33 are raised by respective cylinders 46,47, the material guide assembly 50 is moved downwardly by actuating cylinder 51 under the control of guide rollers 52 which cooperate with, and guide, the vertically reciprocating bar 53 to which the support platform 54 is attached. The support platform 54 carries a plurality of fabric-contacting serrated wheels 55 which are biased downwardly against the fabric by springs 56. In the arrangement shown, the posts 57 are secured to the platform 54 while the wheels 55 are rotatably mounted on a base 58 fixedly carrying spring plate 59. The plate 59 has apertures passing posts 57, and operates to transmit the force of the springs 56 to the wheels 55. The spring tension can be adjusted by nuts 60, or by adjusting the length of the piston rod 51*a* at the clevis nut 51*b*.

As can be seen from FIGS. 2 and 3, the guide wheels 55 are rotatable about horizontal axes that are at an angle $\theta$ with the perpendicular to the longitudinal direction of sewing, and fabric movement. The angle $\theta$ may be adjusted, by pivoting the support shafts 55*a* in the clamp mounts 55*b*, to provide an optimum bias on the fabric tending to feed it into the edge turning guide in an even, positive, fashion.

Immediately upon movement of the guide assembly into the down position described above, the sewing foot 11 is lowered and sewing is started. As the fabric and chain is sewn together, and is fed through the sewing station by the sewing dog 66, the sewn material advances toward the puller jaws 70. While various position-determining means may be employed to time the actuation of the puller, the preferred embodiment uses a stitch counter driven by the sewing station. Upon completion of, for example, twenty stitches, the jaw cylinder 71 is actuated clamping the fabric. The puller is actuated and pulls the sewn fabric through the sewing station under moderate, substantially constant, tension, as described in my noted earlier patent.

Figure 5:
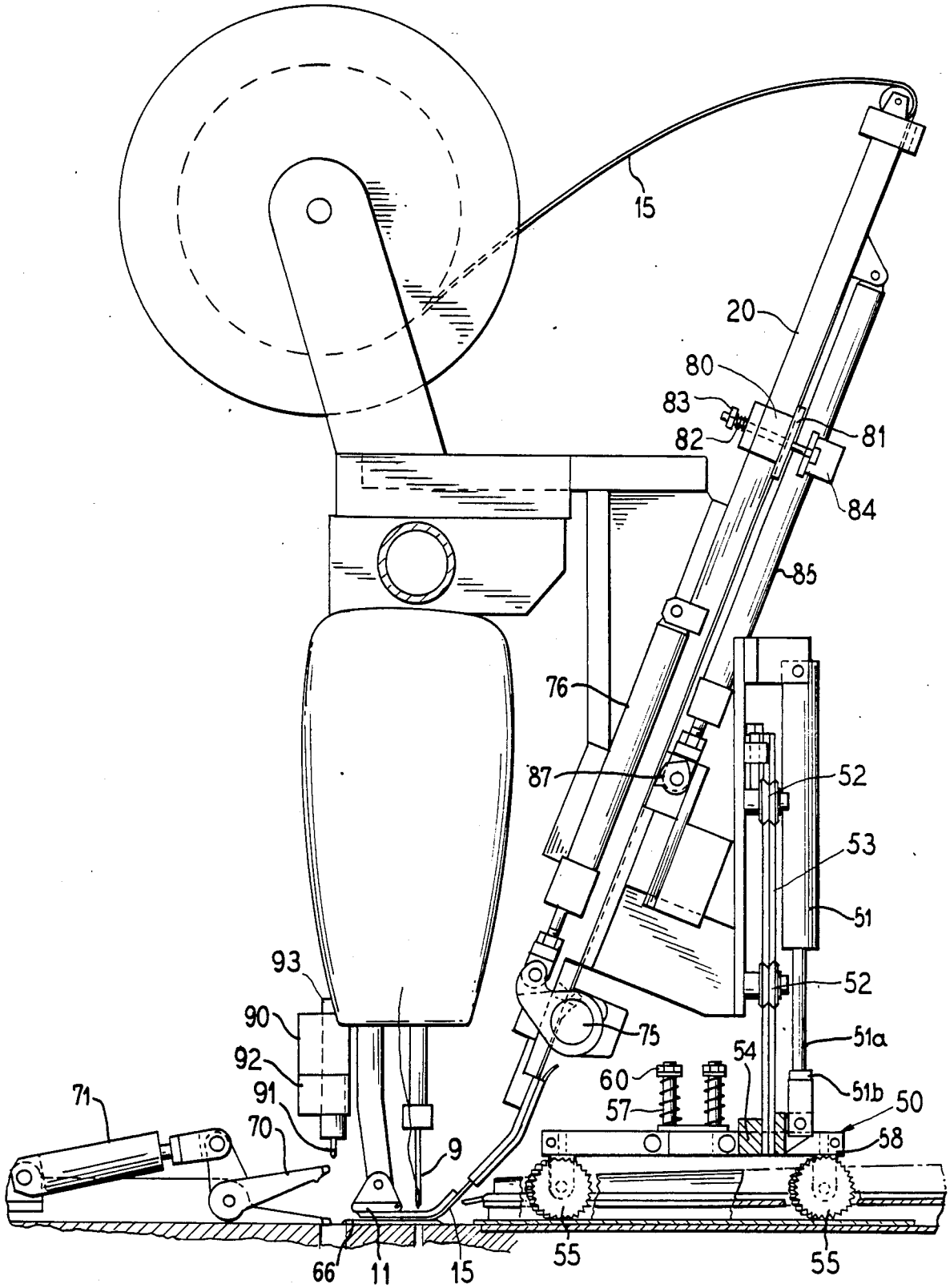
FIG. 5 is a side elevational view similar to that shown in FIG. 4, but taken generally along the line V—V of FIG. 3.

Since, as above described, the fabric is sewn to zipper chain which is fed from a continuous roll, the chain must be cut to length. This is accomplished by an oscillating knife 75 near the lower end of the chain feed channel 20. The knife 75 is oscillated in the counterclockwise direction, as shown in FIG. 5, by air cylinder 76, to cut the chain within the channel. The cylinder 76 is energized by an electric eye sensor 78 adjustably positioned above the fabric guide 25, sensing the passage of the trailing edge of the fabric. The distance of the sensor from the sewing station is the same as, or slightly less than the distance from the sewing station to knife 75. Accordingly, after being cut, the trailing length of chain is sufficient to reach the trailing edge of the fabric. By this means, the chain is always cut to the length of the fabric and the length of the fabric, may be changed without requiring any change in the machine set-up.

The chain guide channel 20 provides an adjustable tension or brake member 80 which presses resiliently against the chain during movement of the chain caused by the operation of the sewing station. In the embodiment shown, the device comprises a pressure plate 81 normally biased against the chain by spring 82. Adjustment of the tension is accomplished by the nut 83. Upon energization of the cylinder (or solenoid if desired) 84, the tension is released and the chain is free to move down the channel 20 without restraint. Upon completion of a sewing cycle, the cut chain must be advanced to the sewing station for the next sewing operation. This is accomplished by energization of cylinder 85 which drives ratchet tooth 87, biased into contact with the tape, a distance generally equal to the length of the trailing chain when cut.

Upon passage of the end of the chain through the sewing station (which may be timed from the time of energization of sensor 78 by a conventional timer switch, or by a conventional stitch counter started, similarly, at the moment of energization of sensor 78, or by an electric eye sensor 88 positioned downstream of the sewing needles), the sewing machine is stopped, the puller is stopped and the two sewing threads trailing the sewn fabric are cut by cutter 90. The cutter 90 may take any form but the preferred device comprises a pair of hooks 91 carried downwardly past the threads by knife-carrying member 92 which is downwardly actuated by a cylinder 93. The hooks 91 are then pulled up by a supplemental cylinder, catching the threads on the way back up to cut them off on a knife blade as they move upwardly past the blade.

At this point in time, the sewing foot is lifted, the material assembly guide 50 is lifted, the puller is restarted to pull the freed sewn material to the stacking position, and the reciprocal chain feed 85,87 operates to move the new chain end to the sewing station.

Figure 7:
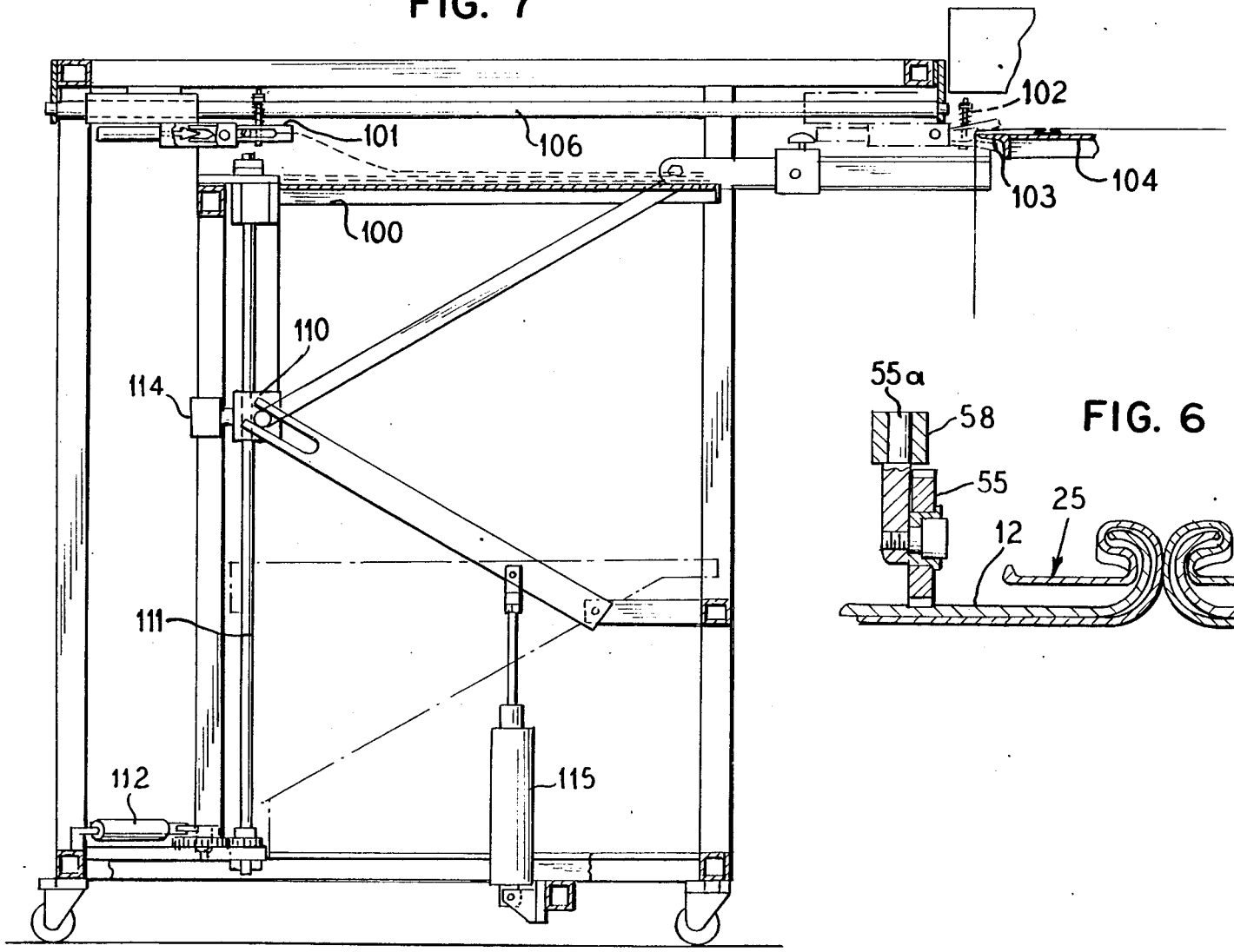
FIG. 7 is an end-elevational view taken along the line VII—VII of FIG. 1 illustrating the finished goods stacking apparatus of the present invention.

Upon completion of the puller motion to the end of its stroke, the material storage system is initiated. As shown in FIGS. 1 and 7 the storage system comprises a vertically movable platform 100 and a pair of transversely movable gripper jaw members 101. At the end of the puller motion, the grippers 101 move to the right as viewed in FIG. 7 to their dotted line position in which the grippers are forced open against their springs 102 by striking the edge 103 of the extension table 104 over which the fabric has been positioned by the puller. Withdrawal of the grippers carries the fabric to the position shown in FIG. 7. At that position the jaw members 101 are opened against the biasing springs 102 by a cylinder 104 actuating rod 105 against one or both of the extensions 101*a* of the jaws 101. When the grippers open the fabric is dropped on the table 100. The grippers 101 are slidably mounted on bar 106 and are moved back and forth thereon by any suitable motor means, such as, for example, the mechanism employed as the fabric puller described in my U.S. Pat. No. 4,497,270.

The table 100 may be fixed at a low level if desired, but it is preferred that the table lower step by step as the sewn fabric pieces are deposited on it. This is accomplished in the embodiment shown by a table stepping apparatus 110. Rotatable table support shaft 111 may be stepped around by a stepping cylinder 112 driving a one-way ratchet clutch. With each activation of the ratchet by the cylinder 112 the shaft 111 moves a desired portion of a turn. Indexing means 113 moves the table downwardly a step for each such turn of the shaft. A helical ball type device such as marketed under the trademark "ROHLIX" has been successfully used and allows the table to be returned by cylinder 115 to its uppermost position when the table has been filled. When filled, an operator removes the stacked material and actuates a switch energizing cylinder 115 and clutch 114 disengaging the "ROHLIX" balls during the upward motion of the table 100. Actuation of the stepping cylinder 112 occurs immediately upon opening of the grippers 101 at their return stroke, in each cycle.

At this point the puller returns to the position immediately downstream of the sewing head and the apparatus is in its initial state ready for the next cycle.

By virtue of the unique guide means provided herein for the fabric and chain, both before sewing, during sewing, and after sewing, a highly efficient sewing apparatus has been provided. It is capable of sewing a chain zipper into opposed, automatically rolled-over edges of fabric with substantial elimination of puckering, waving or like undesirable sewing features that manual sewing occasions. Complicated assembly procedures have been eliminated, so that the operator needs only to approximately align the fabric pieces and press a nearby start button. The apparatus undertakes all fabric handling sewing and stacking; and will perform this process with varying lengths of fabric intermixed, or sequentially, without adjustment so long as the fabric pieces are longer than the distance from the sewing station to the trailing edge sensor 78.

Figure 8A:
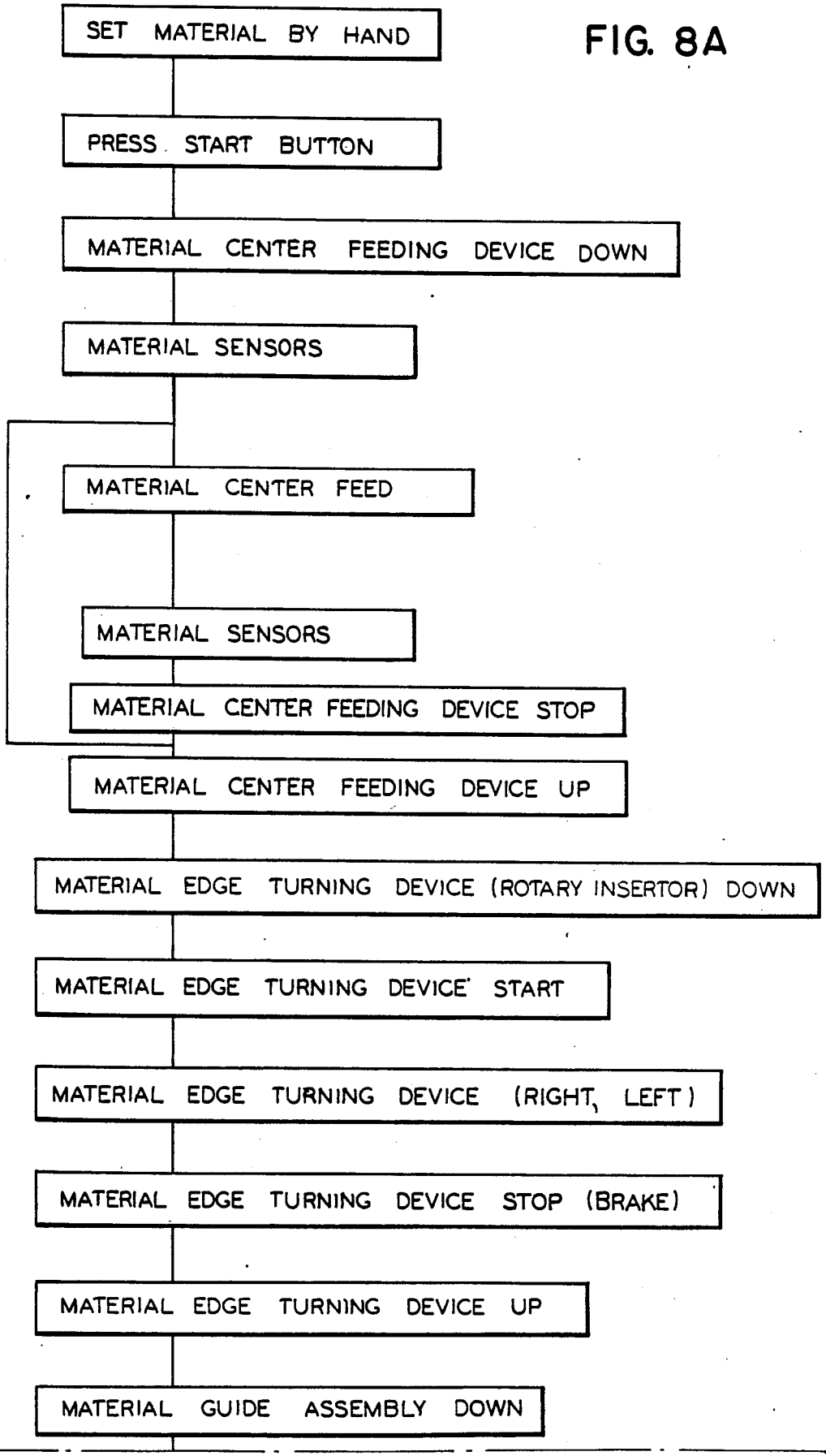
FIGS. 8A and 8B comprise a block type process flow chart setting forth the sequential steps of operation of the apparatus in a typical cycle.
Figure 8B:
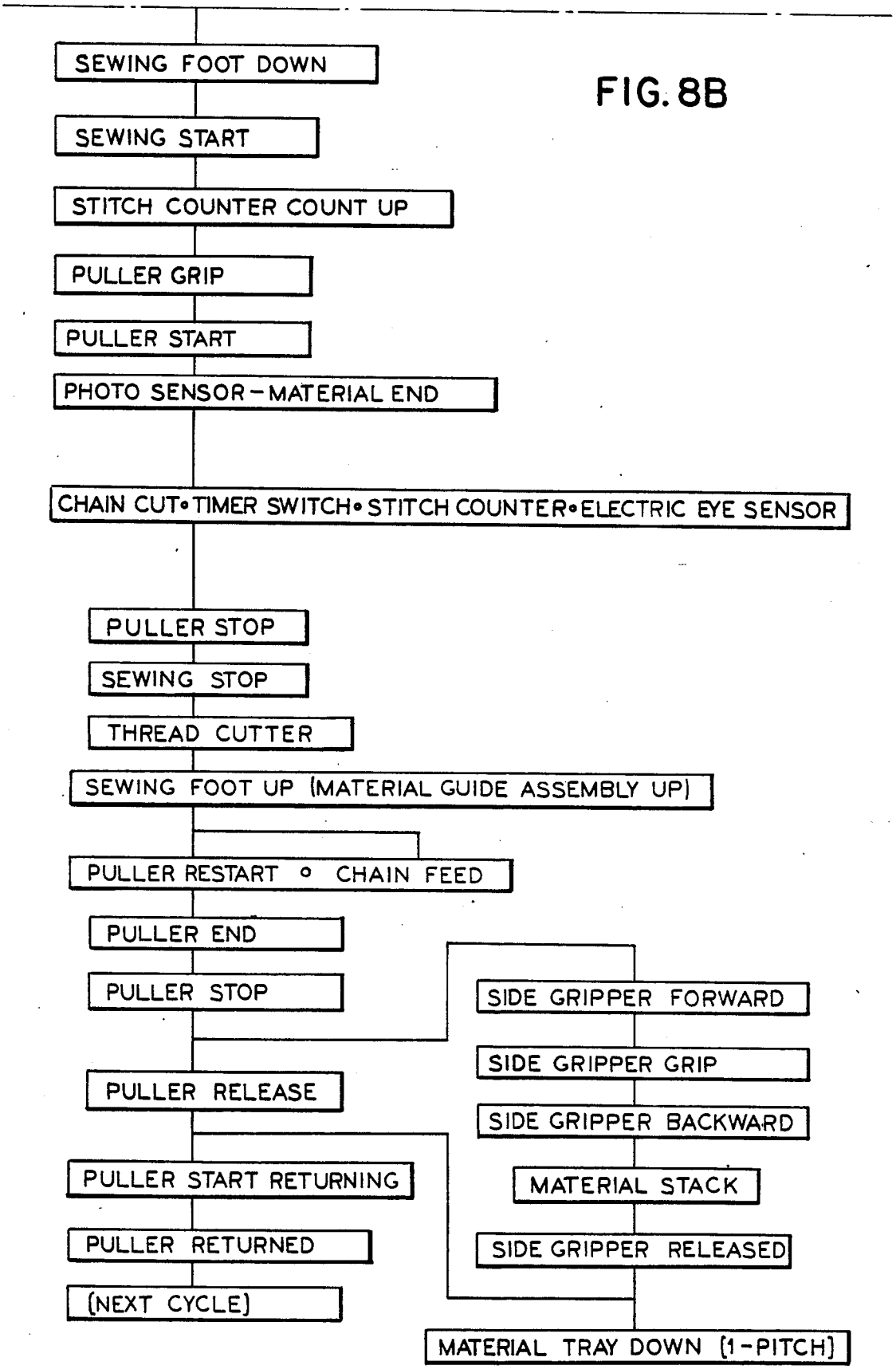

The system may accommodate accurate material handling by providing a bypass circuit when the material is initially set. As shown in FIG. 8A, if the material is correctly set, so that the material covers the sensors the center head is bypassed and the material center feeding device is moved up without a center feeding movement.

It will be understood that air cylinders provide positive, fast operation of the various elements, under the control of electrical switches and valves. Such actuators are conventional and may be replaced by solenoids as actuators where desired. Further, substitutions may be made without departing from the concepts of the present invention, so it is my intent that the scope of the invention be limited only by the scope of the hereinafter appended claims.

I claim as my invention:

1. An automatic sewing apparatus for simultaneously sewing zipper chain to fabric pieces along a sewing path while the chain is in zipper-closed unseparated condition comprising:

(i) a sewing station comprising a pair of transversely spaced sewing needles providing a pair of longitudinally extending rows of stitches;

(ii) assembled chain delivery means directing assembled chain from a remote supply longitudinally to said sewing station;

(iii) fabric guide means directing fabric longitudinally to said sewing station;

(iv) fabric lateral feed means for selectively contacting the fabric and feeding the fabric transversely of the sewing path;

(v) means rolling over the longitudinally extending edge of the fabric including feed means for selectively gripping the fabric adjacent the leading edge thereof and moving the fabric simultaneously laterally toward the fabric guide and forwardly toward the sewing station, and including brake means stopping said movement of each piece of fabric when it reaches the sewing station, (vi) means starting said sewing station to sew said fabric and chain upon completion of said simultaneous movement, (vii) means thereafter identifying the presence of stitched fabric a specified distance downstream of said sewing station, (viii) fabric puller means gripping both pieces of fabric at the specified distance downstream of said sewing station adjacent the output side of the sewing station, and continuously pulling the fabric through the sewing station at a substantially constant tension during sewing;

(ix) fabric trailing-edge sensing means sensing the trailing edge of the fabric a specified distance upstream from the sewing station;

(x) chain cut-off means energized in response to said last named means for cutting the chain to a length dictated by the end of the fabric pieces;

(xi) means identifying the passage of the end of fabric at the sewing station;

(xi) thread cutting means cutting the sewing thread after the passage of the end of the fabric at the sewing station, and (xii) means stopping said sewing station.

2. The structure of claim 1 wherein material directing means is continuously applied to said fabric on both sides of the longitudinal line of stitching urging the fabric toward the line of stitching as the fabric moves forward to the sewing station.

3. The structure of claim 1 wherein said means thereafter identifying the presence of stitched fabric comprises means counting a predetermined number of stitches made by said sewing needles after start up of said sewing station.

4. The structure of claim 1 wherein said chain cutting means is in said chain delivery means.

5. The structure of claim 1 wherein said means identifying the passage of the end of the fabric at the sewing station comprises a stitch counter initiated upon actuation of said trailing edge sensing means.

6. The structure of claim 1 wherein said means identifying the passage of the end of the fabric at the sewing station comprises an electric eye positioned downstream of said station.

7. The structure of claim 2 wherein the material directing means comprises at least one pair of rollers downwardly biased against the fabric pieces freely and rotatable about generally horizontal axes positioned so that perpendiculars drawn through the axes will intersect downstream of the rollers.

8. The structure of claim 1 including positive chain advancing means moving the remaining chain to said sewing station after operation of said thread cutting means.

9. The structure of claim 8 wherein said chain advancing means includes tension means pressing against said chain in said guide during sewing station operation and means disengaging said tension means following chain cut-off allowing said chain advancing means can freely move the chain.

10. The structure of claim 1 wherein said means for moving said fabric simultaneously laterally and forwardly comprises a gripper oscillating about a vertical pivot.

11. The structure of claim 10 wherein said brake means includes means sensing the position of the leading edge of the fabric as it reaches the sewing station and further includes means contacting and preventing further oscillation of said gripper upon energization of the last named sensing means.

12. The structure of claim 1 wherein said fabric puller means pulls the sewn fabric along a horizontal table supporting the fabric on one side of the chain only whereby the fabric hangs down along the edge of the table and stacking means moving laterally toward said table and including opposed jaws resiliently gripping said fabric above and below said table, means moving said jaws laterally away from said table to a position over a support, and means opening said jaws when said jaws have passed substantially over said support.

13. The structure of claim 12 including means stepping said last named support downwardly with each cycle of lateral movement of said jaws.

* * * * *